US009748642B2

(12) United States Patent
Grandfield

(10) Patent No.: US 9,748,642 B2
(45) Date of Patent: Aug. 29, 2017

(54) LOW-PROFILE LOOP ANTENNA

(71) Applicant: The Charles Stark Draper Laboratory, Inc., Cambridge, MA (US)

(72) Inventor: John E. Grandfield, Plymouth, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 239 days.

(21) Appl. No.: 14/870,869

(22) Filed: Sep. 30, 2015

(65) Prior Publication Data

US 2016/0181697 A1 Jun. 23, 2016

Related U.S. Application Data

(60) Provisional application No. 62/095,125, filed on Dec. 22, 2014.

(51) Int. Cl.
*H01Q 7/00* (2006.01)
*H01Q 1/48* (2006.01)

(52) U.S. Cl.
CPC ..... *H01Q 1/48* (2013.01); *H01Q 7/005* (2013.01)

(58) Field of Classification Search
CPC ..... H01Q 7/00; H01Q 9/16; H01Q 7/005
USPC ..... 343/741, 748, 866
See application file for complete search history.

(56) References Cited

U.S. PATENT DOCUMENTS 6,650,301 B1 * 11/2003 Zimmerman ..... H01Q 9/26 343/795
7,446,729 B2 * 11/2008 Maruyama ..... G06K 19/07749 343/742
2005/0007293 A1 1/2005 Handelsman ..... 343/867
2006/0109183 A1 5/2006 Rosenberg et al. ..... 343/702
2007/0008223 A1 1/2007 Chen et al. ..... 343/700
2009/0184880 A1 7/2009 Marklein et al. ..... 343/866
2009/0322634 A1 12/2009 Yun et al. ..... 343/741
(Continued)

OTHER PUBLICATIONS

Korean Intellectual Property Office, International Search Report—International Application No. PCT/US2015/063120, dated Mar. 31, 2016 together with the Written Opinion of the International Searching Authority, 10 pages.

(Continued)

*Primary Examiner* — Dameon E Levi
*Assistant Examiner* — Hasan Islam
(74) *Attorney, Agent, or Firm* — Sunstein Kann Murphy & Timbers LLP

(57) ABSTRACT

A low-profile loop antenna includes a driven element disposed very close, in some cases within about 0.005 wavelengths (λ) or closer, to a ground plane, while maintaining sizable gain and usable feed point impedance. Width of the driven element varies along its circumference, such that two diametrically opposed portions of the driven element are wider, and therefore have lower impedance, than other diametrically opposed portions of the driven element. The antenna may be configured to achieve a desired feed point impedance. The antenna may be tuned over a wide bandwidth. Metallic objects placed near the center of the antenna loop do not significantly degrade performance of the antenna. A parasitic element may be added to create a circularly-polarized antenna, without significantly increasing the antenna's profile.

20 Claims, 13 Drawing Sheets

(56) References Cited

U.S. PATENT DOCUMENTS

2015/0022411 A1* 1/2015 Ali ..... H01Q 1/50
343/793

OTHER PUBLICATIONS

Analog Devices, Inc., "Microstrip and Stripline Design," MT-094 Tutorial, 7 pages, Jan. 2009.
Ayorinde, et al., "Performance Characteristics of Loop Antennas above a Ground Plane of Finite Extent," Progress in Electromagnetics Research Symposium Proceedings, pp. 769-774, Mar. 25-28, 2013.
Evans, et al., "The Effect of Element Width on the Impedance Bandwidth and Mode for the Rectangular Monopole Antenna," Dublin Institute of Technology, 3 pages, May 23, 2004.
Jefferies, "Experiments on Loops above Ground," antenneX Online, issue 106, 8 pages, Feb. 2006.
McMahill, "Microstrip Analysis/Synthesis Calculator," http://mcalc.sourceforge.net/, 5 pages, Feb. 16, 2010.
Shoamanesh, et al., "Characteristics of circular loop antennas above a lossless ground plane," IEEE Transactions on Antennas and Propagation, vol. 29, issue 3, May 1981 [Abstract].
Silicon Laboratories, "Design of Printed Trace Differential Loop Antennas," Application Note AN639, 28 pages, Jun. 2014.

* cited by examiner

LOW-PROFILE LOOP ANTENNA

CROSS REFERENCE TO RELATED APPLICATIONS

This application claims the benefit of U.S. Provisional Patent Application No. 62/095,125, filed Dec. 22, 2014, titled "Antenna Designs," the entire contents of which are hereby incorporated by reference herein, for all purposes.

TECHNICAL FIELD

The present invention relates to radio frequency antennas and, more particularly, to low-profile loop antennas.

BACKGROUND ART

A loop antenna is a radio frequency antenna consisting of a loop, or several loops, of wire, tubing or other electrical conductor with ends of the loop connected to a feed line. Conventional loop antennas are balanced and are conventionally fed with balanced feed lines to avoid balance mismatches between the antennas and the feed lines, or with unbalanced feed lines via baluns. A loop antenna's resonant frequency is determined by circumference of the loop. A loop antenna resonates at a frequency whose wavelength (λ) equals the circumference of the loop and at other odd multiples of that frequency, taking into account velocity factor of the loop element conductor.

Although most loop antennas are circular, distorting the loop into a different closed shape generally does not greatly alter its characteristics. For instance, a quad antenna consists of a resonant loop, and usually additional parasitic elements, in square shapes, where each leg of the square is about one-quarter (¼) wavelength long. In general, gain of a loop antenna is directly proportional to area enclosed by the loop. Thus, other things being equal, a quad antenna exhibits slightly less gain than a circular loop antenna. In many ways, loop antennas can be viewed as deformed folded dipole antennas. For example, loop antennas have electrical characteristics, such as high radiation efficiency, similar to folded dipole antennas. For a given antenna operated in a linear medium, the antenna's transmit and receive characteristics, such as impedance, radiation pattern and sensitivity, are identical.

Absent a ground plane, a loop antenna radiates, or is sensitive, in directions normal to a plane of the loop, thus in two opposite directions. Further directivity can be obtained by increasing the loop circumference to three or five wavelengths. However, it is more common to increase gain by adding a ground plane spaced apart from a driven loop, using an array of driven loops or a Yagi configuration that includes parasitic loop elements. However, all these methods significantly increase overall size of the antenna.

Polarization of a loop antenna is not obvious by looking at the loop itself. The polarization depends on location of the antenna's feed point. If a vertically oriented loop is fed at its bottom, the antenna is horizontally polarized. However, feeding such a loop from a side makes the antenna vertically polarized.

A ground plane may be used to increase directivity, and therefore gain, of a loop antenna by preventing radiation or reception in one direction normal to the plane of the loop. However, loop, dipole and patch antennas dramatically loose gain when driven elements are placed too close to ground planes, which reduces the capability of a system to effetely receive weak signals or efficiently transmit signals.

Prior art loop antennas require a significant, i.e., at least about 1/10 wavelength, space between their driven elements and their ground planes to achieve sizable gain. Furthermore, as the distance between a driven loop and its ground plane is reduced, impedance of the loop antenna decreases, such as to about 5-10 ohms, making it difficult or impossible to match a feed line to the antenna.

Gain reductions due to close-spacing of ground planes in loop antennas may be compensated by increasing power used to drive the antennas, or increasing power supplied to receive-signal amplifiers, or by increasing the diameters of the loops. Neither option is particularly attractive, especially in compact, low power consumption systems.

SUMMARY OF EMBODIMENTS

A low-profile loop antenna includes a driven element disposed very close, such as about 0.005 wavelength (λ), or in some cases closer, to a ground plane, while maintaining sizable gain and usable feed point impedance. To achieve this close spacing, the width of the driven element varies along the circumference of the driven element, such that two diametrically opposed portions of the driven element are wider than other diametrically opposed portions of the driven element. The wider portions have lower impedances than the narrower portions. In general, the closer the driven element is spaced from a ground plane, the wider, and therefore lower impedance, the two diametrically opposed low-impedance portions should be, relative to the high-impedance portions, to maintain an acceptable gain and feed impedance. Furthermore, the low-impedance portions of the driven element appear to act as a balun, enabling the loop antenna to be fed with an unbalanced feed line, without a separate balun.

The antenna may be tuned by a variable capacitor over a wide bandwidth. Due to current distributions in the driven element, metallic objects placed near the center of the antenna loop do not significantly degrade performance of the antenna. A parasitic element may be added to create a circularly-polarized antenna, without significantly increasing the antenna's profile.

An embodiment of the present invention provides a loop antenna. The loop antenna has a design frequency and a design wavelength of the design frequency. The loop antenna includes a planar electrically conductive ground plane, a loop driven element and a first dielectric material disposed between the ground plane and the driven element.

The driven element is electrically conductive. The driven element is partitioned to have two ends. The ends of the driven element define a feed point between them. The driven element has a circumference equal to about a first odd integral multiple of the design wavelength. The driven element is disposed on a first plane. The first plane is parallel to the ground plane. The driven element is spaced by at most about 0.01 times the design wavelength from the ground plane.

Width of the driven element, as measured in the first plane, varies along the circumference of the driven element. The width of the driven element varies, such that two diametrically opposed low-impedance portions of the driven element are each wider than each of two remaining high-impedance portions of the driven element. The width of the driven element varies, such that the two diametrically opposed low-impedance portions of the driven element each have impedances, at the design frequency, no greater than about one-quarter impedance of each of two remaining high-impedance portions of the driven element.

The planar electrically conductive ground plane has an outer perimeter. An outer perimeter of the driven element registers, perpendicular to the first plane, within the outer perimeter of the ground plane.

The loop antenna may also include a first variable capacitor electrically connected across, and disposed within about 1/16 of the design wavelength of, the feed point.

The widths of the low-impedance portions may depend on spacing between the driven element and the ground plane. For a given design frequency, closer driven element-to-ground plane spacing may correspond with wider low-impedance portions.

The impedances of the low-impedance portions may depend on spacing between the driven element and the ground plane. For a given design frequency, closer driven element-to-ground plane spacing may correspond with lower impedances of the low-impedance portions.

A ratio of the impedances of the high-impedance portions to the impedances of the low-impedance portions may depend on spacing between the driven element and the ground plane. For a given design frequency, closer driven element-to-ground plane spacing may correspond with a higher ratio.

The width of the driven element may vary continuously along the circumference of the driven element.

The driven element may include an approximately rectangular cross-sectional, electrically conductive, first trace attached to one surface of the first dielectric material. The ground plane may include an electrically conductive second trace attached to an opposite surface of the first dielectric material.

The driven element may include respective first, second, third and fourth elongated portions of the first trace.

The first elongated portion of the first trace may have a length equal to about one-quarter the first odd multiple of the design wavelength. The first elongated portion of the first trace may form a first microstrip, relative to the ground plane and the first dielectric material. One of the high-impedance portions includes the first microstrip.

The second elongated portion of the first trace may have a length equal to about one-quarter of the first odd multiple of the design wavelength. The second elongated portion of the first trace may form a second microstrip, relative to the ground plane and the first dielectric material. The second microstrip may be perpendicular to the first microstrip. One end of the second microstrip may be electrically connected to one end of the first microstrip. One of the low-impedance portions may include the second microstrip.

The third elongated portion of the first trace may have a length equal to about one-quarter of the first odd multiple of the design wavelength. The third elongated portion of the first trace may form a third microstrip, relative to the ground plane and the first dielectric material. The third microstrip may be perpendicular to the second microstrip. One end of the third microstrip may be electrically connected to the other end of the second microstrip. The other of the high-impedance portions may include the third microstrip.

The fourth elongated portion of the first trace may have a length equal to about one-quarter of the first odd multiple of the design wavelength. The fourth elongated portion of the first trace may form a fourth microstrip, relative to the ground plane and the first dielectric material. The fourth microstrip may be perpendicular to the third microstrip. One end of the fourth microstrip may be electrically connected to the other end of the third microstrip. The other end of the fourth microstrip may be electrically connected to the other end of the first microstrip. The fourth microstrip may be electrically partitioned about half way along its length into two portions. The fourth microstrip may define the feed point between the two portions of the fourth microstrip. The other of the low-impedance portions may include the fourth microstrip.

The driven element may be spaced apart from the ground plane by a distance no greater than about 0.005 times the design wavelength. The loop antenna may exhibit a gain of at least about 1.2 dBiL.

Widths of the first and fourth elongated portions of the first trace may be such that the impedance of each of the first and third microstrips is about 10Ω at the design frequency. Widths of the second and third elongated portions of the first trace may be such that the impedance of each of the second and fourth microstrips is about 50Ω at the design frequency.

Width of the first elongated portion of the first trace may be equal to about width of the third elongated portion of the first trace. Width of the second elongated portion of the first trace may be equal to about width of the fourth elongated portion of the first trace. The width of the second elongated portion of the first trace may be at least about three times the width of the first elongated portion of the first trace.

The loop antenna may also include a first variable capacitor electrically connected across, and disposed within about 1/16 of the design wavelength of, the feed point.

Each of the first, second, third and fourth elongated portions of the first trace may be linear.

The loop antenna may also include an electrically conductive loop parasitic element and a second dielectric material. The second dielectric material may be disposed between the driven element and the parasitic element.

The parasitic element may have a circumference equal to about a second odd multiple of the design wavelength. The parasitic element may be disposed on a second plane. The parasitic element may be parallel to the driven element. The parasitic element may be spaced by at most about 0.01 times the design wavelength from the driven element. Width of the parasitic element, as measured in the second plane, may vary along the circumference of the parasitic element. The width of the parasitic element may vary, such that two diametrically opposed low-impedance portions of the parasitic element are each wider than each of two remaining high-impedance portions of the parasitic element. The width of the parasitic element may vary, such that the two diametrically opposed low-impedance portions have impedances, at the design frequency, no greater than about one-quarter impedance of each of the two remaining high-impedance portions of the parasitic element.

The width of the parasitic element may vary continuously along the circumference of the parasitic element.

The parasitic element may be partitioned and have two ends defining a tuning point between the ends. The loop antenna may also include a second variable capacitor electrically connected across, and disposed within about 1/16 of the design wavelength of, the tuning point.

The two low-impedance portions of the parasitic element may be sized and shaped substantially as the two low-impedance portions of the driven element are sized and shaped. The two high-impedance portions of the parasitic element may be sized and shaped substantially as the two high-impedance portions of the driven element are sized and shaped. The parasitic element may be centered over the driven element, as viewed perpendicular to the first plane. The parasitic element may be rotated about 90 degrees, relative to the driven element, about an axis perpendicular to the first plane and extending through the center of the parasitic element.

The driven element may be attached to one surface of the second dielectric material. The parasitic element may include an approximately rectangular cross-sectional, electrically conductive, second trace attached to the other surface of the second dielectric material.

The loop antenna may also include a metallic object disposed on a same side of the ground plane as the driven element. The metallic object may be disposed within about 1/16 of the design wavelength of the first plane. The metallic object may be disposed within an outer perimeter of the driven element.

The metallic object may include an electronic circuit electrically coupled to the feed point.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, methods and apparatus are disclosed for low-profile loop antennas that include driven elements disposed very close to ground planes, while maintaining sizable gains and usable feed point impedances. In some embodiments, a driven element may be placed as close as about 0.003 wavelength (λ), or in some cases closer, to the ground plane. The antenna may be configured to achieve a desired feed point impedance. The antenna may be tuned over a wide bandwidth. Metallic objects placed near the center of the antenna loop do not significantly degrade performance of the antenna. A parasitic element may be added to create a circularly-polarized antenna, without significantly increasing the antenna's profile.

As noted, conventional loop antennas dramatically loose gain when driven elements are placed too close to ground planes. However, embodiments of the present invention provide good gain, even when ground planes are placed close to driven elements. For example, in one embodiment, the ground plane is placed within about 0.002 wavelengths of the driven element, yet the antenna provides about 1.7 dBiL gain at 1.732 GHz and an input impedance of about 30 ohms (Ω).

Figure 1:
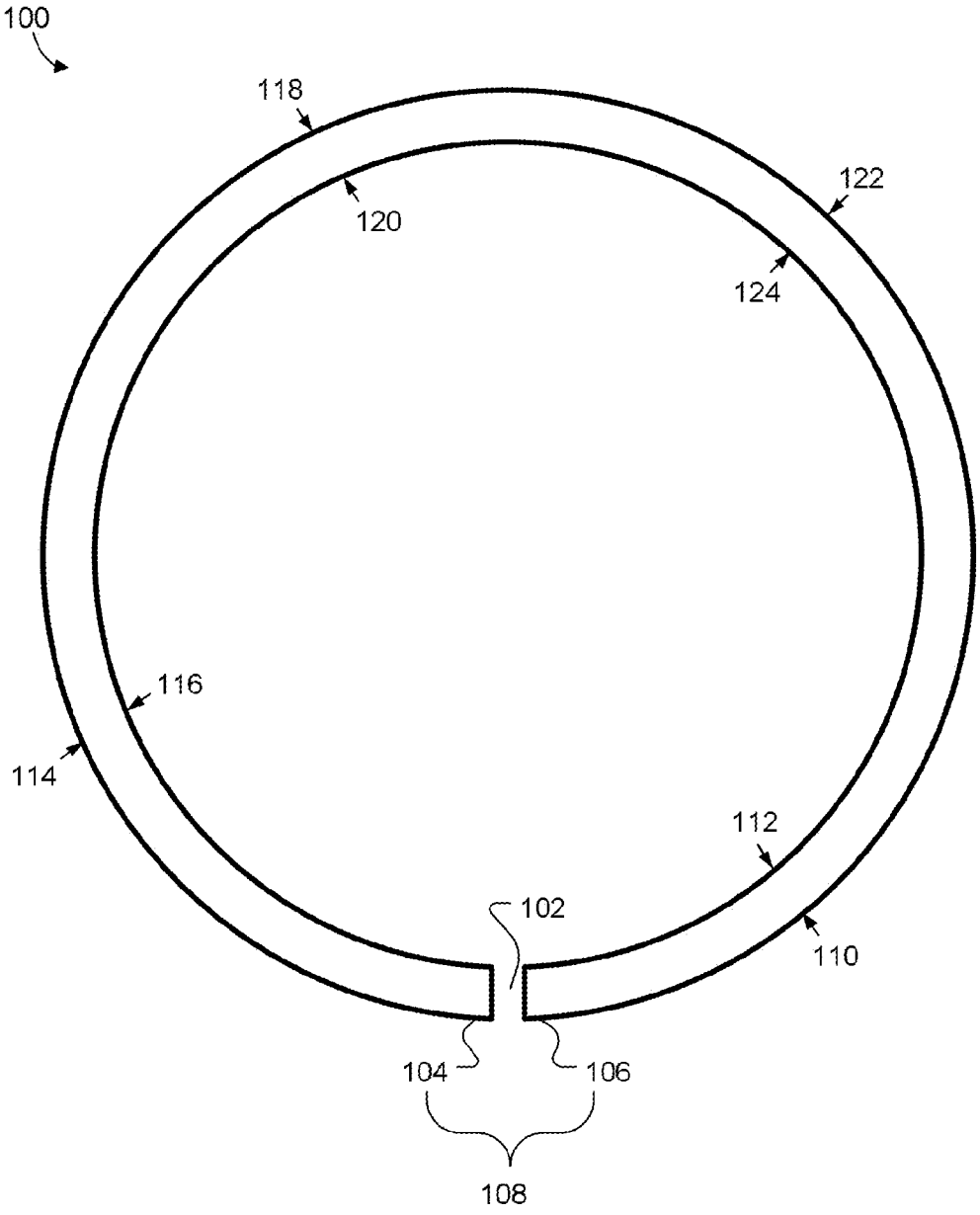
(Prior Art) Fig. 1
FIG. 1 is a front view of a driven element of a loop antenna, according to the prior art.

Conventional loop antennas have driven elements of constant widths. FIG. 1 is a front view of a driven element 100 of a loop antenna, according to the prior art. The driven element 100 lies in a plane. The driven element 100 defines a partition (electrical discontinuity) 102, leaving the driven element 100 with two ends 104 and 106 that define a feed point 108 between the two ends 104 and 106. The feed point 108 is balanced. Consequently, to feed the loop antenna 100 with an unbalanced feed line, such as a coaxial cable, a balun is conventionally used. The driven element 100 has a constant width along its entire circumference. Exemplary widths of the driven element are indicated by pairs of arrows at 110, 112, 114, 116, 118, 120, 122 and 124. The widths 110-124 are measured in the plane of the driven element 100.

Variable Width Driven Elements

In any embodiment of the present invention, the width of the driven element varies along the circumference of the driven element, such that two diametrically opposed portions of the driven element are wider than other diametrically opposed portions of the driven element. The wider portions have lower impedances than the narrower portions. In general, the closer the driven element is spaced from a ground plane, the wider, and therefore lower impedance, the two diametrically opposed low-impedance portions should be, relative to the high-impedance portions, to maintain an acceptable gain and feed impedance. Furthermore, the low-impedance portions of the driven element appear to act as a balun, enabling the loop antenna to be fed with an unbalanced feed line, without a separate balun.

Generally Round Driven Element Embodiments

Figure 2:
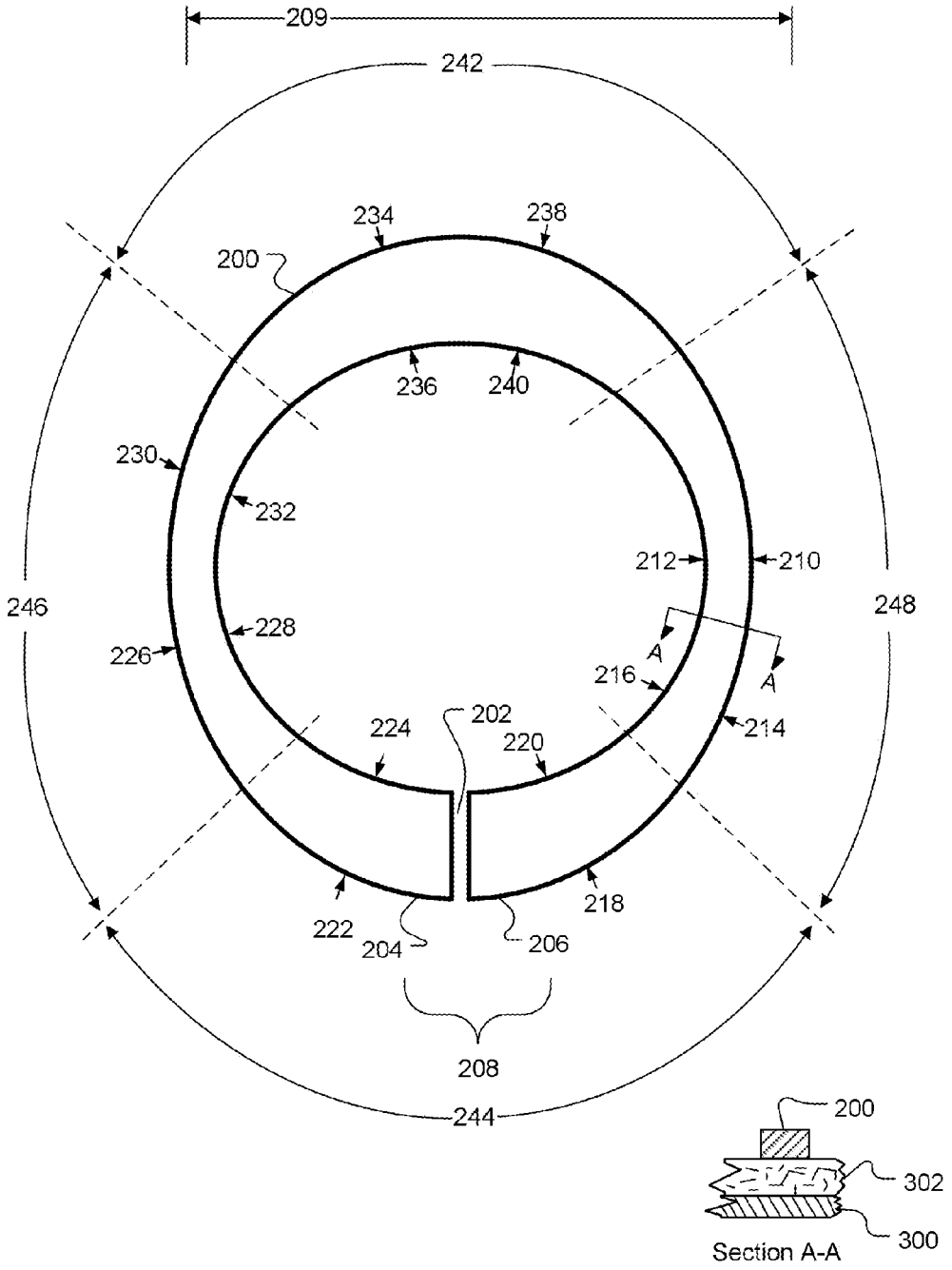
FIGS. 2 and 3 are respective front and side views of a loop antenna having a generally round driven element, according to an embodiment of the present invention.
Figure 3:
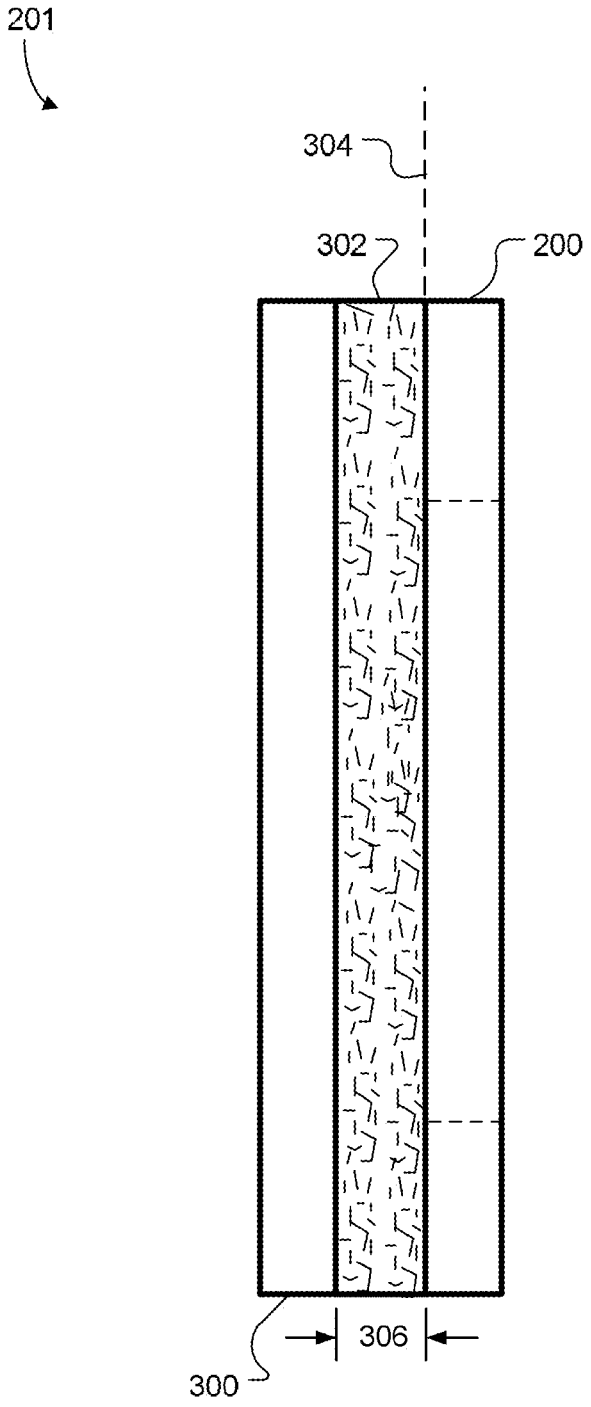

FIGS. 2 and 3 are respective front and side views of a driven element 200 of a loop antenna 201, according to an embodiment of the present invention. The antenna has a design frequency and a design wavelength of the design frequency. The design wavelength may be calculated from the design frequency according to the well-known formula $\lambda=C/f$, taking into consideration velocity factors of materials used to construct the driven element 200.

As shown in FIG. 3, the loop antenna 201 includes the driven element 200, an electrically conductive ground plane 300 and a dielectric material 302 between the driven element 200 and the ground plane 300. Any suitable dielectric material may be used. In some embodiments, a dielectric material having a dielectric constant of about 2.17 and a loss tangent of about 0.0009 are used. Suitable dielectric materials are available from Taconic, Advanced Dielectric Division, 136 Coonbrook Road, P.O. Box 69, Petersburgh, N.Y. 12138. To reduce cost, ordinary FR-4 printed circuit board (PCB) substrate may be used as the dielectric material 302. However, high dielectric losses in FR-4 at microwave frequencies and insufficient uniformity of dielectric constant in FR-4 may recommend against its use in some cases. An alumina substrate may be more suitable as a dielectric material 302. Dielectric materials with dielectric constants greater than about 3 may cause excessive losses and reduce antenna efficiency.

The driven element 200 and the ground plane 300 may be formed as conductive traces on opposite surfaces of the dielectric material 302, such as by conventional printed circuit board (PCB) fabrication techniques. The traces may be made of any suitable material, such as copper. The traces, including the driven element 200, may have approximately rectangular cross-sectional shapes, as shown in FIG. 2, Section A-A. Each trace should be thicker than an expected skin depth at the design frequency. The driven element 200 is spaced apart from the ground plane 300 by a distance 306 at most about 0.01 times the design wavelength. It should be noted that this spacing is at least ten times closer than in the prior art, leading to a substantial reduction in profiles of loop antennas.

The driven element 200 lies in a plane 304 and has a circumference, measured in the plane 304, equal to about an odd integral multiple, i.e., 1, 3, 5, 7, etc., of the design wavelength. The driven element 200 defines a partition (electrical discontinuity) 202, leaving the driven element 200 with two ends 204 and 206 that define a feed point 208 between the two ends 204 and 206. However, unlike the prior art, the feed point 208 can be fed with an unbalanced feed line, such as a coaxial cable. Advantageously, no external balun is required.

The width of the driven element 200 varies along its circumference. The "width" of the driven element 200 is measured in the plane 304 and refers to the width of an electrically conductive portion of the driven element 200, such as the trace, not an overall width 209 of the driven element 200. Pairs of arrows 210, 212, 214, 216, 218, 220, 222, 224, 226, 228, 230, 232, 234, 236, 238 and 240 indicate widths of the driven element 200 at various locations around the circumference of the driven element 200. For simplicity, the widths of the driven element 200 are referred to as widths 210-240. In some places, widths are referred to by the reference numerals for their corresponding pairs of arrows.

Each of the widths 234/236, 238/240, 222/224 and 218/220 is greater than any of the widths 210/212, 214/216, 226/228 or 230/232. Each of two diametrically opposed portions 242 and 244 of the driven element 200 is wider than each of two other (narrower) diametrically opposed portions 246 and 248 of the driven element 200. Consequently, the two wider portions 242 and 244 have lower impedances, at the design frequency, than the two narrower portions 246 and 248.

The widths of the driven element, and in particular the widths of the wider portions 242 and 244, are selected, relative to the widths of the two narrower portions 246 and 248, such that impedances, at the design frequency, of the narrower portions 246 and 248 are each at least about four times the impedances of each of the wider portions 242 and 244. The two low-impedance portions 242 and 244 may, but need not, be identically shaped, and the two high-impedance portions 246 and 248 may, but need not, be identically shaped.

The widths of the low-impedance portions 242 and 244 depend on the spacing 306 between the driven element 200 and the ground plane 300. For a given design frequency, closer driven element-to-ground plane spacing 306 corresponds with wider, and therefore lower impedance, low-impedance portions 242 and 244, relative to the narrower high-impedance portions 246 and 248. Thus, a ratio of the impedances of the high-impedance portions 246 and 248 to the impedances of the low-impedance portions 242 and 244 depends on the spacing 306 between the driven element 200 and the ground plane 300. For a given design frequency, closer driven element-to-ground plane spacing 306 corresponds with a higher ratio.

Each of the portions 242, 244, 246 and 248 forms a respective microstrip transmission line, relative to the ground plane 300 and the dielectric material 302. Each of the microstrips is about one-quarter of the circumference of the driven element 200, i.e., about one-quarter of the odd multiple of the design wavelength.

Generally Rectangular Driven Element Embodiments

Figure 5:
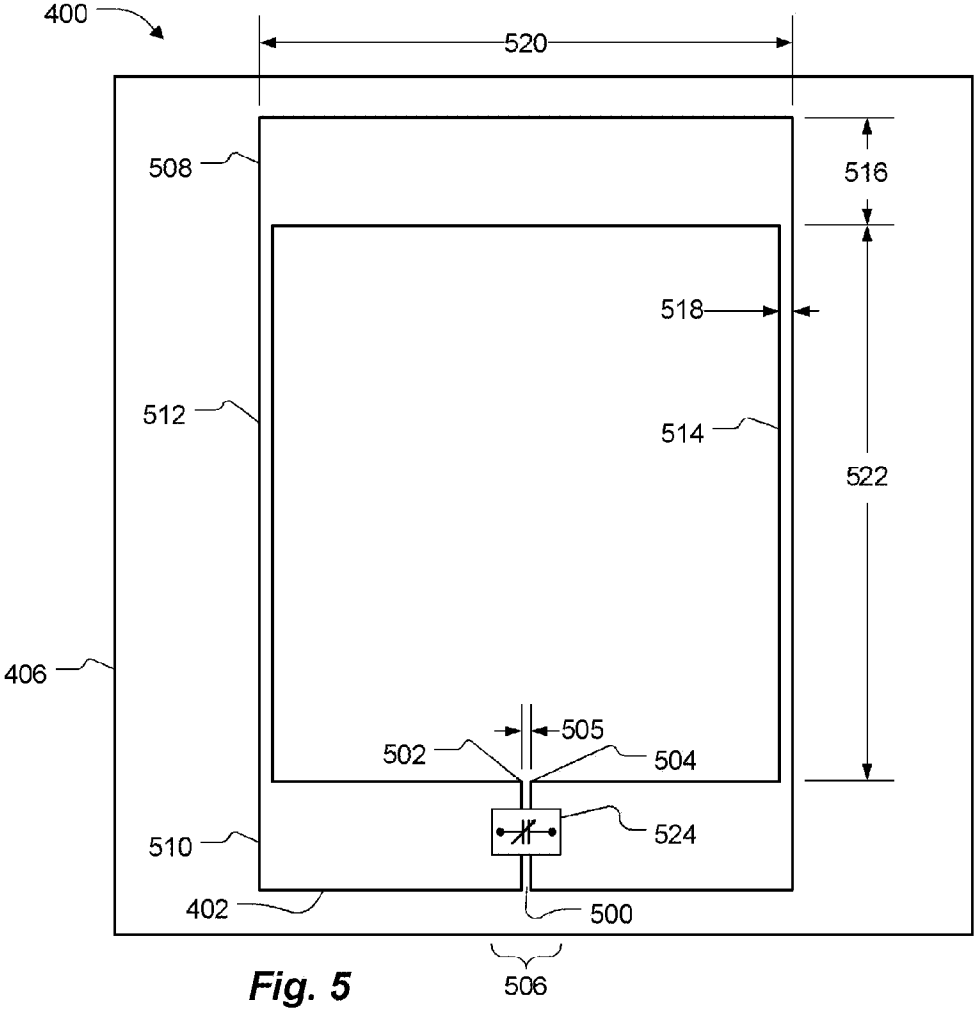
FIGS. 4 and 5 are respective side and front views of a loop antenna having a generally quadrilateral-shaped driven element, according to another embodiment of the present invention.
Figure 4:
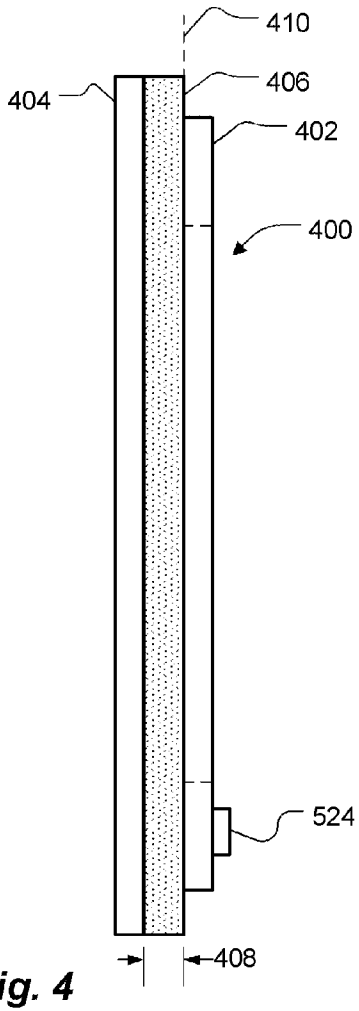

The width of the driven element 200 may vary continuously along the circumference of the driven element 200, or the width of the driven element 200 may be constant along portions of the circumference. The embodiment shown in FIGS. 2 and 3 has a generally round driven element 200 and curved high-impedance and low-impedance portions 246, 248, 242 and 244. However, loop antennas with other shaped driven elements are contemplated. For example, FIGS. 4 and 5 are respective side and front views of a loop antenna 400 having a generally quadrilateral-shaped driven element, according to another embodiment of the present invention.

The loop antenna 400 includes a planar electrically conductive ground plane 404 and a dielectric material 406 between the driven element 402 and the ground plane 404. The driven element 402 may be formed as a conductive trace on one surface of the dielectric material 406, and the ground plane 404 may be formed as another conductive trace on an opposite surface of the dielectric material 406.

The loop antenna 400 has a design frequency and a design wavelength of the design frequency. The driven element is separated from the ground plane 404 by a distance 408, which in embodiments is at most about 0.01 times the design wavelength. The driven element 402 lies in a plane 410 and has a circumference, measured in the plane 410, equal to about an odd integral multiple of the design wavelength. The driven element 402 defines a partition (electrical discontinuity) 500, leaving the driven element 402 with two ends 502 and 504 that define a feed point 506 between the two ends 502 and 504. The two ends 502 and 504 are spaced apart a distance 505 of about 0.100 inches (2.54 mm). Like the loop antenna 201 of FIGS. 2 and 3, the feed point 506 can be fed with an unbalanced feed line.

Also like the loop antenna 201 of FIGS. 2 and 3, the driven element 402 includes two diametrically opposed portions 508 and 510 that are wider than two other diametrically opposed portions 512 and 514. The wider (low-impedance) portion 508 of the driven element has a width 516 that is at least about three times the width 518 of the narrower (high-impedance) portion 514. The wider (low-impedance) portion 508 has a length 520 about one-quarter the circumference of the driven element, i.e., about one-quarter the odd integral multiple of the design wavelength. The other wider (low-impedance) portion 510 has a similar width. Similarly, the narrower (high-impedance) portion 518 has a length 522 about one-quarter the circumference of the driven element, i.e., about one-quarter the odd integral multiple of the design wavelength. The other narrower (high-impedance) portion 512 has a similar width.

As in the loop antenna 201 of FIGS. 2 and 3, the portions 508, 510, 512 and 514 of the driven element 402 form respective microstrips, relative to the ground plane 404 and the dielectric material 406. Impedances of the microstrips may be calculated or estimated according to well-known formulae and models, such as those described by Bahl and Trivedi. These formulae and models take into consideration factors, such as dielectric constant, thickness of the dielectric material and width and thickness of the conductive trace. For example, the impedance of a microstrip is a function of, among other things, a ratio of the thickness to the width of the conductive trace. It should be kept in mind that, because part of the fields from the microstrip conductors may exist in air, the effective dielectric constant may be somewhat less than the substrate's dielectric constant, also known as the relative permittivity. Using a suitable formula or model, lengths and other dimensions of the microstrips may be calculated or estimated from desired impedances of the microstrips.

A variable capacitor 524 may be electrically connected across the ends 502 and 504 of the driven element 402, i.e., across the feed point 506, to tune the resonant frequency of the loop antenna 400 over an about 10% bandwidth. The variable capacitor 524 should be mounted close to the feed point 506, such as within about 1/16 of the design wavelength of the feed point 506. Most conventional antennas' resonant frequencies and input impedances change when the antennas are loaded with a dielectric material. However, loop antennas according to the present invention largely maintain a relatively constant impedance when subjected to dielectric loading, as discussed in more detail below. If the resonant frequency of the loop antenna 400 changes, such as a result of dielectric loading, a desired resonant frequency may be restored by adjusting the variable capacitor 524.

In one embodiment, each portion 508, 510, 512 and 514 of the driven element is about one-quarter wavelength long, at a design frequency of about 1.732 GHz. In this embodiment, the driven element 402 is about 0.015 inches (0.381 mm) thick. The low-impedance portions 508 and 510 have lengths 520 of about 1.880 inches (47.752 mm) and widths 516 of about 0.315 inches (8.001 mm). The high-impedance portions 512 and 514 have lengths 522 of about 1.800 inches (45.720 mm) and widths 518 of about 0.046 inches (1.168 mm). The spacing 408 between the driven element 402 and the ground plane 404 is about 0.015 inches (0.381 mm) (0.002945 wavelengths, at the design frequency). Using a dielectric material 406 having a dielectric constant of about 2.17 and a loss tangent of about 0.0009, each low-impedance portion 508 of the driven element has an impedance of about 10 ohms, and each high-impedance portion 512 and 514 has an impedance of about 50 ohms. At the feed point 506, the loop antenna exhibits an input impedance of about 30 ohms.

Figure 6:
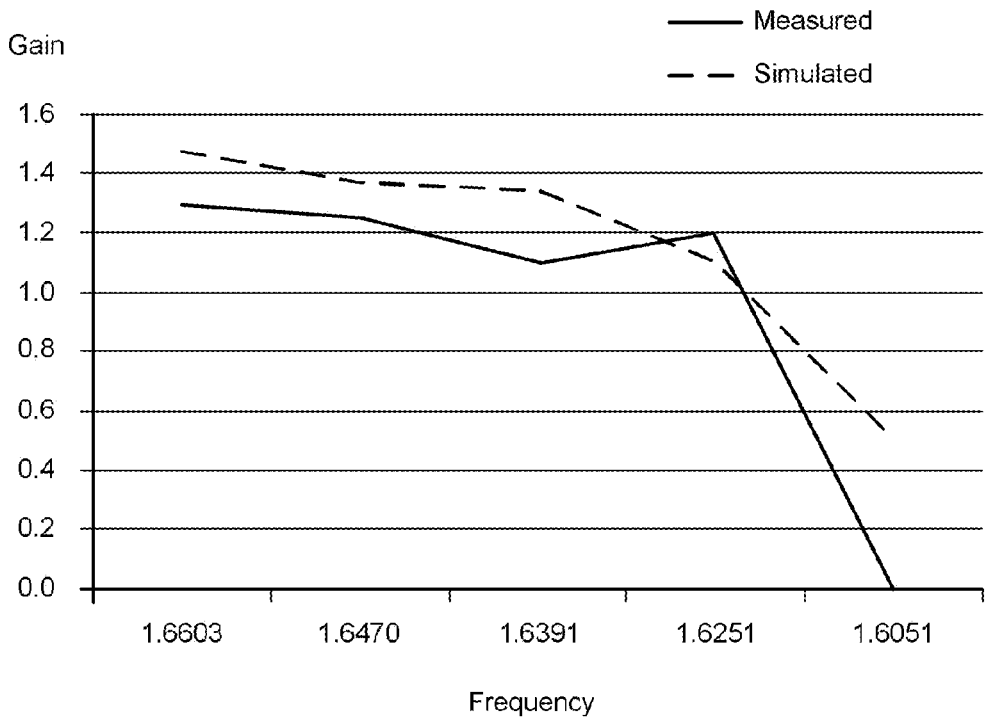
FIG. 6 is a graph of measured and simulated gains of the antenna of FIGS. 4 and 5.

Although this embodiment is not necessarily optimized for performance, computer simulation of this embodiment predicts a gain of about 1.7 dBiL at the design frequency. Measured gain ranges from about 1.2 to about 1.3 dBiL over a frequency range of about 1.60 GHz to about 1.66 GHz, as depicted in a graph in FIG. 6. It should be noted that the simulated results do not account for an about 0.2 dB loss due to the feed cable.

Figure 7:
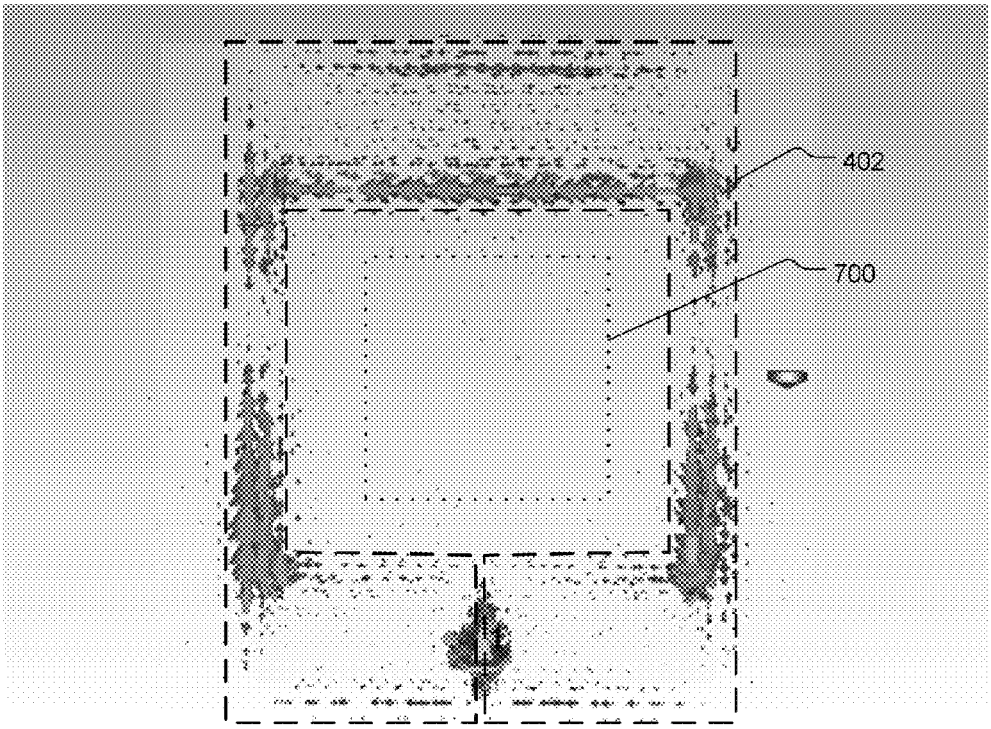
FIG. 7 is a graph of computer simulated surface currents flowing in the driven element of the antenna of FIGS. 4 and 5.

FIG. 7 is a graph of computer simulated surface currents flowing in the driven element 402. An outline of the driven element 402 is superimposed in dashed line on the graph. This graph indicates the driven element 402 operates similar to a full-wave loop antenna. In addition, the graph indicates currents as would be expected with a balanced feed line, despite the fact that the antenna is fed with an unbalanced feed line. Furthermore, the simulation indicates low current on the ground of the feed line. Thus, the low-impedance portions 508 and 510 appear to act as a balun.

Reducing the driven element-to-ground plane spacing 408 to about 0.007 inches (0.178 mm) results in a reduction in gain to about −3 dBiL at 1.6 GHz and a reduction in the antenna input impedance. However, the widths 516 of the low-impedance portions 508 and 510 may be increased to compensate for the low input impedance, although at driven element-to-ground plane spacings less than about 0.007 inches (0.178 mm), the electric field is likely to short out.

Circular Polarized Embodiments

Figure 9:
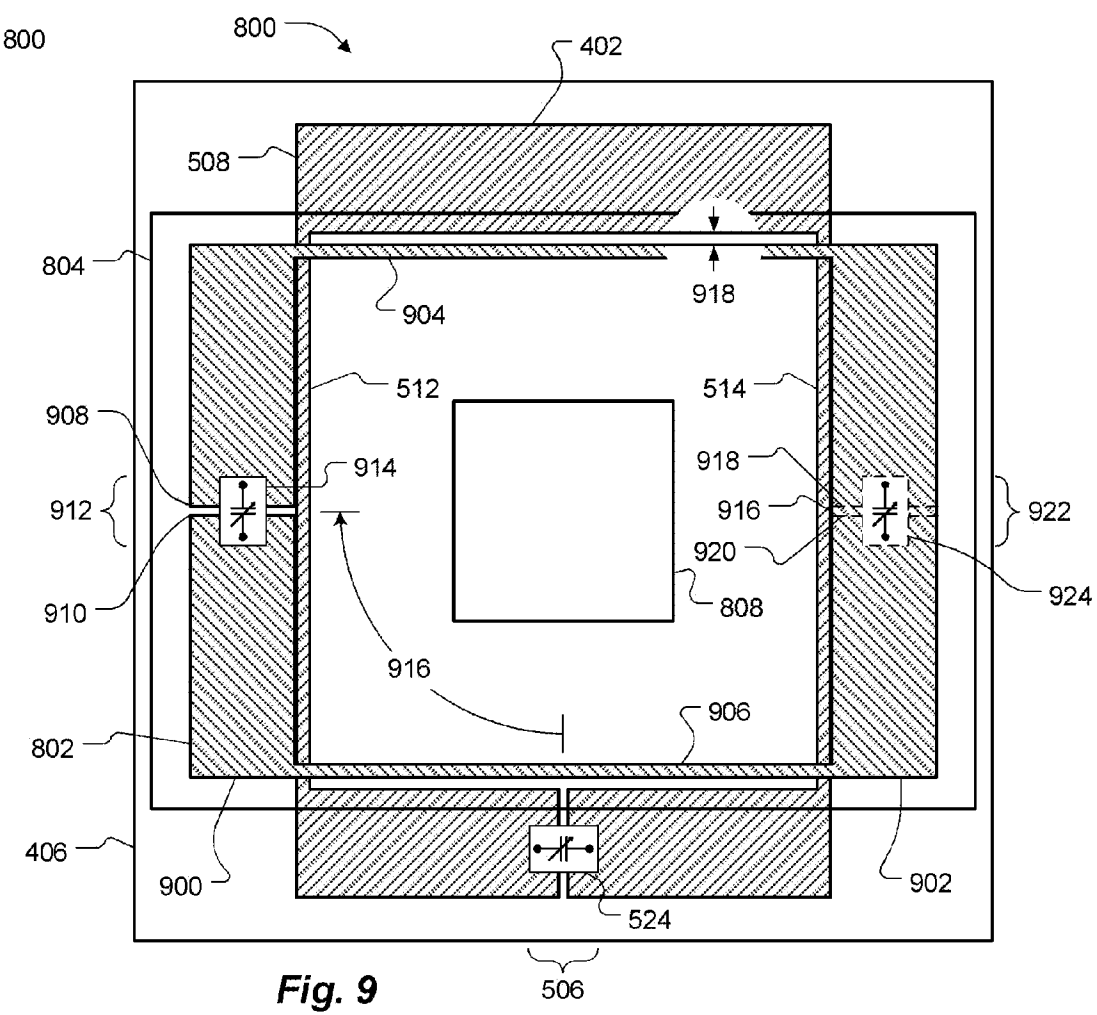
FIGS. 8 and 9 are respective side and front views of a circular polarized loop antenna having a parasitic element, according to an embodiment of the present invention.
Figure 8:
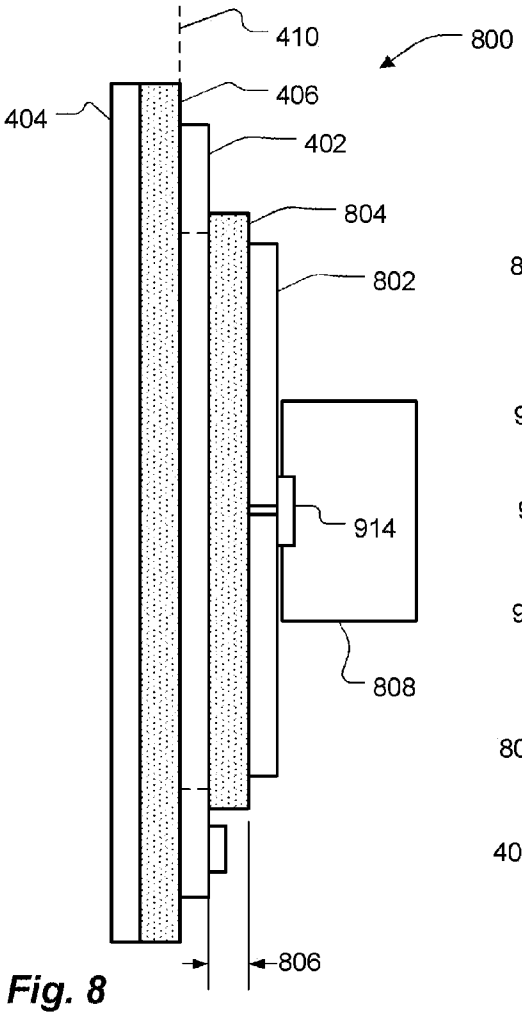

A parasitic element may be added to a loop antenna to create a circularly-polarized antenna, without significantly increasing the antenna's profile. FIGS. 8 and 9 are respective side and front views of a loop antenna 800 that includes such a parasitic element 802, according to an embodiment of the present invention. The antenna 800 is similar to the antenna 400 described with respect to FIGS. 4 and 5. For example, the antenna 800 includes a ground plane 404, a driven element 402, a dielectric material 406 between the driven element 402 and the ground plane 404, as well as a variable capacitor 524 electrically connected to the feed point 506 of the driven element 402, as described herein.

The antenna 800 also includes the parasitic element 802 disposed near the driven element 402, on a side of the driven element 402 opposite the ground plane 404. The driven element 402 and the parasitic element 802 are shown in FIG. 9 with different hash marks to facilitate distinguishing them from each other, although FIG. 9 is not a cross-sectional view.

The antenna 800 also includes a second dielectric material 804 between the driven element 402 and the parasitic element 802. The second dielectric material 804 is shown only in outline in FIG. 9, so the driven element 402 can be seen below it. The parasitic element 802 may be spaced a small distance 806, such as about 0.003 inches (0.076 mm), from the driven element 402. The second dielectric material 804 may have a dielectric constant of about 2.17 and a loss tangent of about 0.0009.

The parasitic element 802 is shaped similarly, but not necessarily identically, to the driven element 402, including relatively wide low-impedance portions 900 and 902 and relatively narrow high-impedance portions 904 and 906, as discussed with respect to the driven element 402 in FIGS. 4 and 5. Because the parasitic element 802 is fed by radio-frequency coupling from the driven element 402, the impedance at the drive point of the parasitic element 802 is higher. The impedance of the low-impedance portions 900 and 902 depend on the amount of coupling between the driven element 402 and the parasitic element 802. The impedance of the high-impedance portions 904 and 906 is about 50 ohms in the embodiment shown in FIG. 9.

The parasitic element 802 has two ends 908 and 910 and defines a tuning point 912 between the two ends 908 and 910. A second variable capacitor 914 may be electrically connected across the tuning point 912 to re-tune the antenna 800, such as after dielectric loading, as discussed herein. In the other low-impedance portion 902, the parasitic element 802 may define a second partition (electrical discontinuity) 916, leaving the parasitic element 802 with another two ends 918 and 920 that define a second tuning point 922 between the two ends 918 and 920. A third variable capacitor 924 may be electrically coupled across the second tuning point 922. As with the second variable capacitor 914, the second variable capacitor 924 should be disposed close, such as within about 1/16 wavelength, to the second tuning point 922.

The parasitic element 802 is at least approximately centered above the center of the driven element 402, although the parasitic element 802 is rotated in the plane of the parasitic element 802 by 90 degrees about its center, with respect to the driven element 402. In the embodiment shown in FIG. 9, the parasitic element 802 is rotated clockwise, as indicated by arrow 916, relative to the driven element 402. Thus, the tuning point 912 is rotated clockwise 916 by 90 degrees, relative to the feed point 506 of the antenna 800. This 90-degree clockwise 916 rotation causes the circular polarization of the antenna 800 to be left handed. If, alternatively, the parasitic element 802 is rotated such that the tuning point 912 is counterclockwise 90 degrees (not shown) of the feed point 506 of the antenna 800, the circular polarization is right handed.

Although not shown, additional parasitic elements may be added, each additional parasitic element being disposed along a boresight of the antenna 800 and spaced apart from the previous parasitic element by a respective dielectric material. The additional parasitic elements may be used to increase an amount of radio frequency (RF) coupling between the driven element 402 and the parasitic element(s) 802, etc.

The amount of radio frequency (RF) coupling between the driven element 402 and the parasitic element(s) 802, etc., determines the axial ratio of the circular polarized signal of the antenna 800. The amount of coupling depends, at least in part, on a distance 918 between the driven element 402 and the parasitic element 802.

Metallic Object Disposed Close to Center of Driven Element

Figure 10:
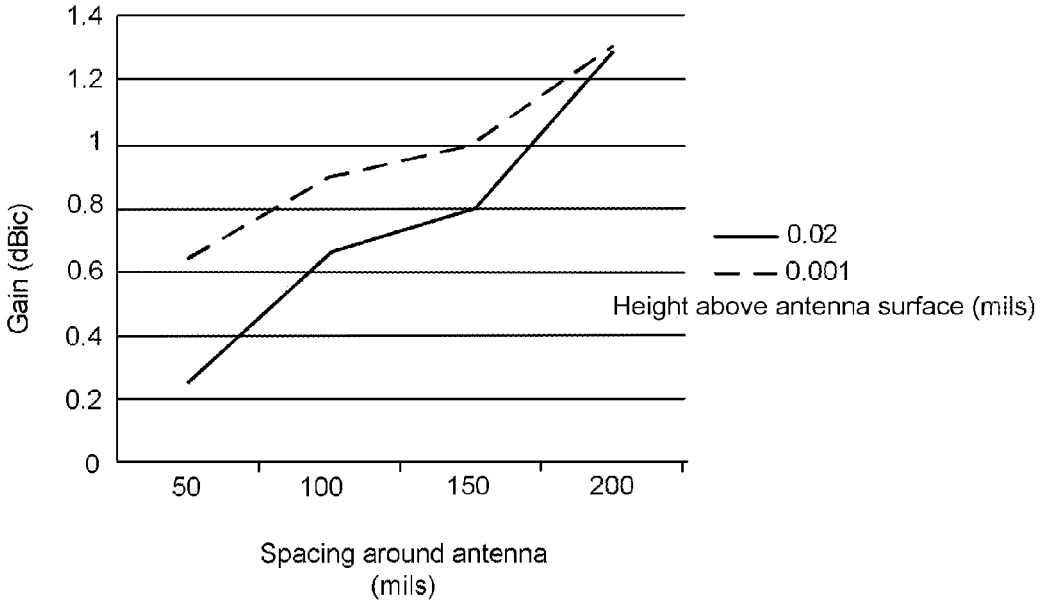
FIG. 10 is a graph of gain versus spacing between elements of an antenna embodiment, according to the present invention, and a metallic object placed in a central portion of the antenna, as generated by a computer simulation.

Referring again to FIG. 7, the graph of computer simulated surface currents flowing in the driven element 402, it can be seen that little, if any, current flows in a central portion 700 of an antenna that includes such a driven element 402. Computer simulations confirm that placing a metallic object in the central portion 700 does not significantly impact performance of the antenna. Simulations of different sized metal objects placed in the central portion 700 of the antenna, spaced about 0.001 inches (0.025 mm) to about 0.020 inches (0.508 mm) above the antenna's surface and at least an about 0.200 inches (5.080 mm) from any antenna element, showed very little degradation in the antenna's gain. FIG. 10 is a graph of gain versus spacing between a metallic object placed in the central portion 700 and the elements of the antenna, as generated by a computer simulation.

Thus, a metallic object 808 (FIGS. 8 and 9), such as an electronic circuit, may be placed in the central portion 700, without significantly degrading the antenna's performance. For example, a radio transmitter or receiver circuit coupled to the antenna may be placed in the central portion 700.

Circular Polarized Loop Antenna Test Results

Figure 11:
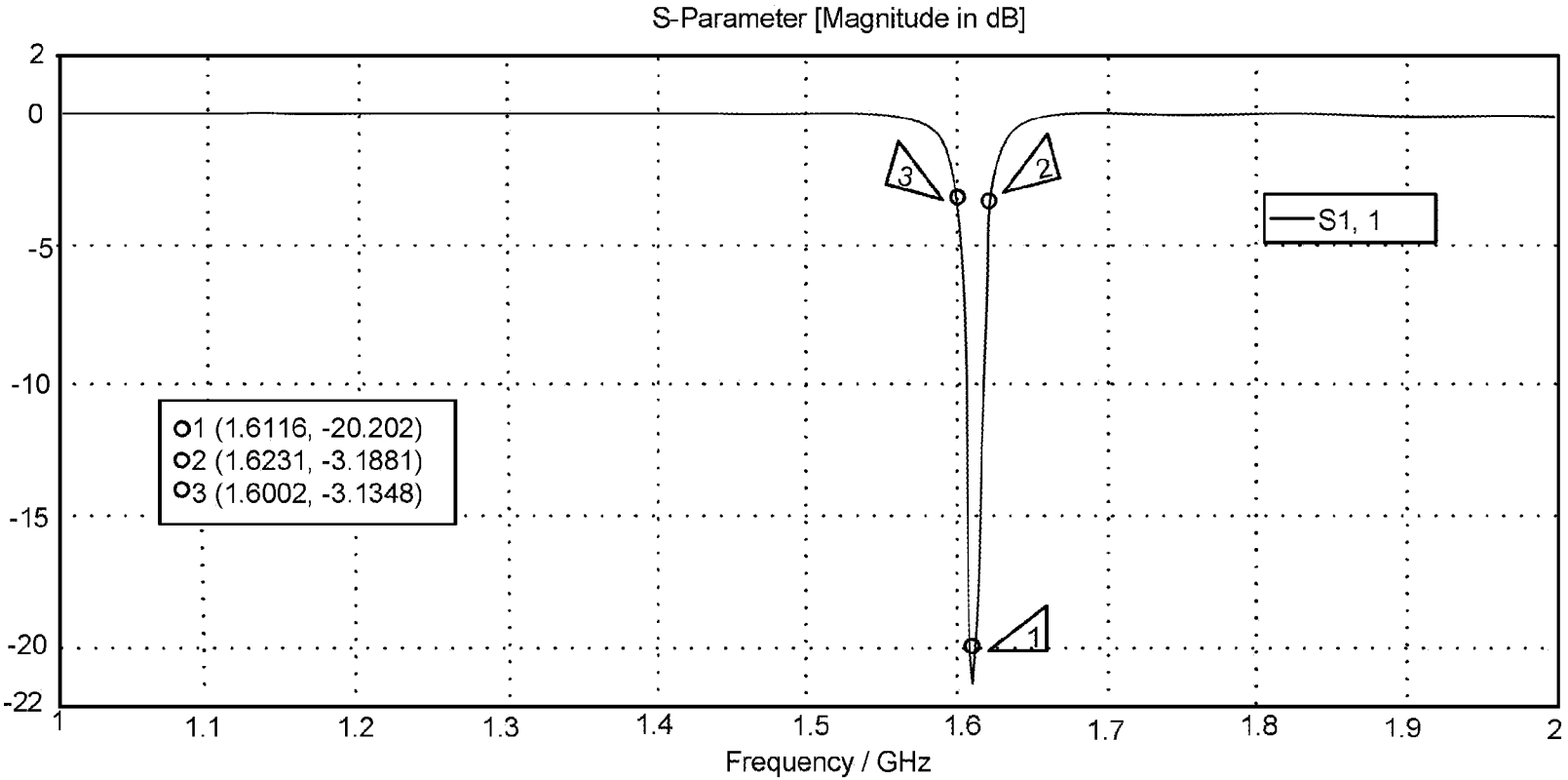
FIG. 11 is a graph showing bandwidth of the circular polarized loop antenna of FIGS. 8 and 9.

FIG. 11 is a graph showing bandwidth of the circular polarized loop antenna 800, as generated by a computer simulation. The bandwidth shown is 13 MHz, assuming a 2:1 mismatch.

Figure 12:
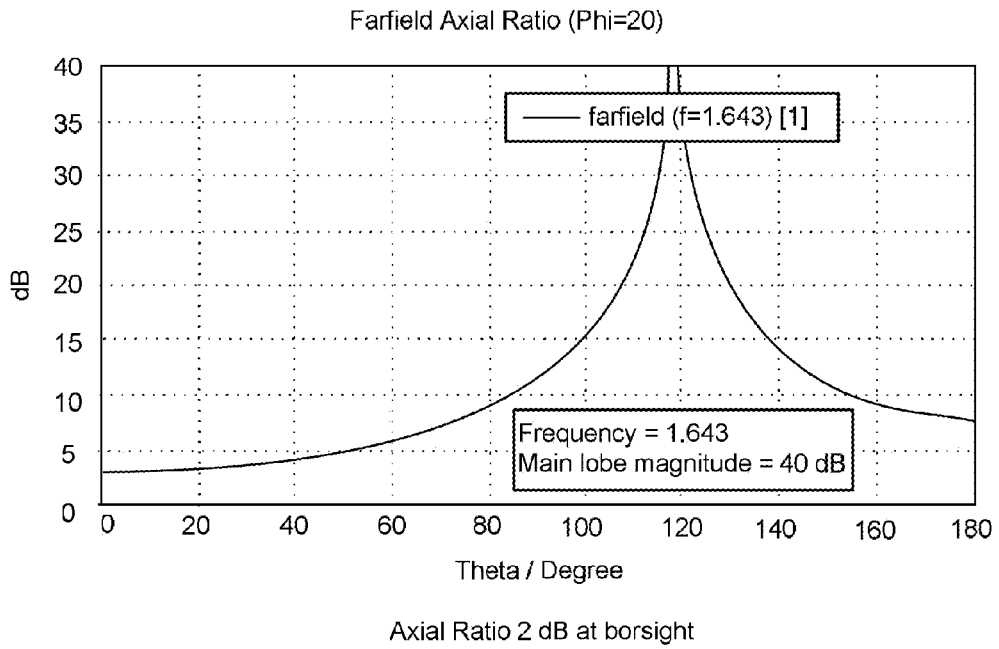
FIG. 12 is a graph showing axial ratio of the circular polarized loop antenna of FIGS. 8 and 9, as generated by a computer simulation.

FIG. 12 is a graph showing axial ratio of the circular polarized loop antenna 800, as generated by a computer simulation.

Dielectric Loading Test Results

Most conventional antennas' resonant frequencies and input impedances change when the antennas are loaded with a dielectric material. For example, a housing of a mobile telephone, an aircraft radome or walls of a building may be close enough to an antenna to dielectrically load the antenna. However, loop antennas according to the present invention largely maintain relatively constant impedance when subjected to dielectric loading. If the resonant frequency of the loop antenna 400 or 800 changes, as a result of dielectric loading, a desired resonant frequency may be restored by adjusting the variable capacitor 524 (FIGS. 5 and 9) and, optionally, any variable capacitor(s), such as variable capacitor 914, coupled to a parasitic element(s).

Figure 13:
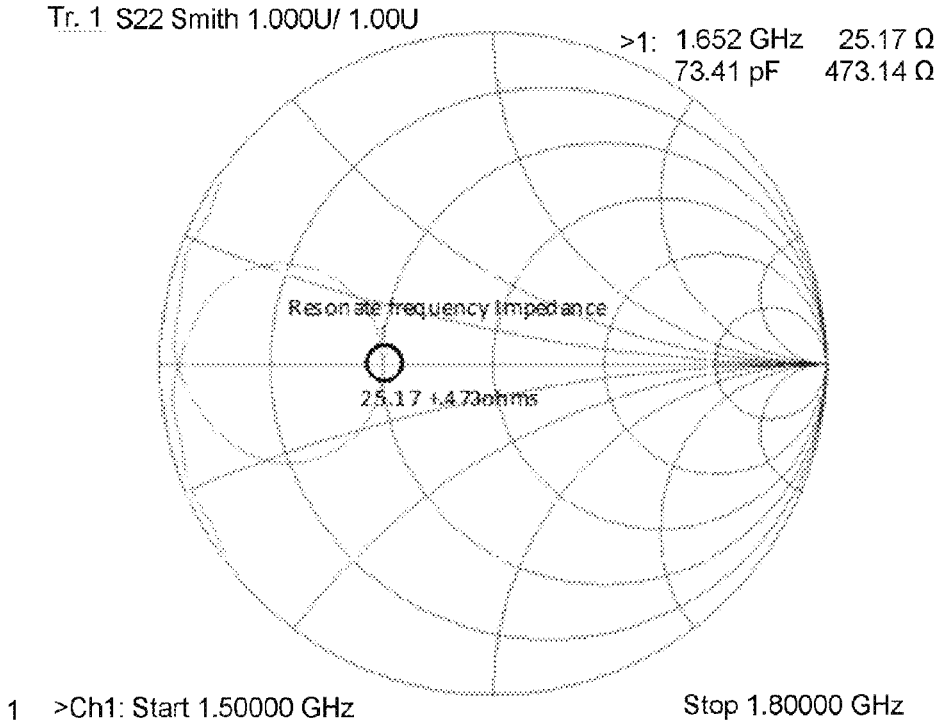
FIGS. 13 and 14 are graphs that illustrate reference impedance and gain measurements of an unloaded loop antenna embodiment, according to the present invention.
Figure 14:
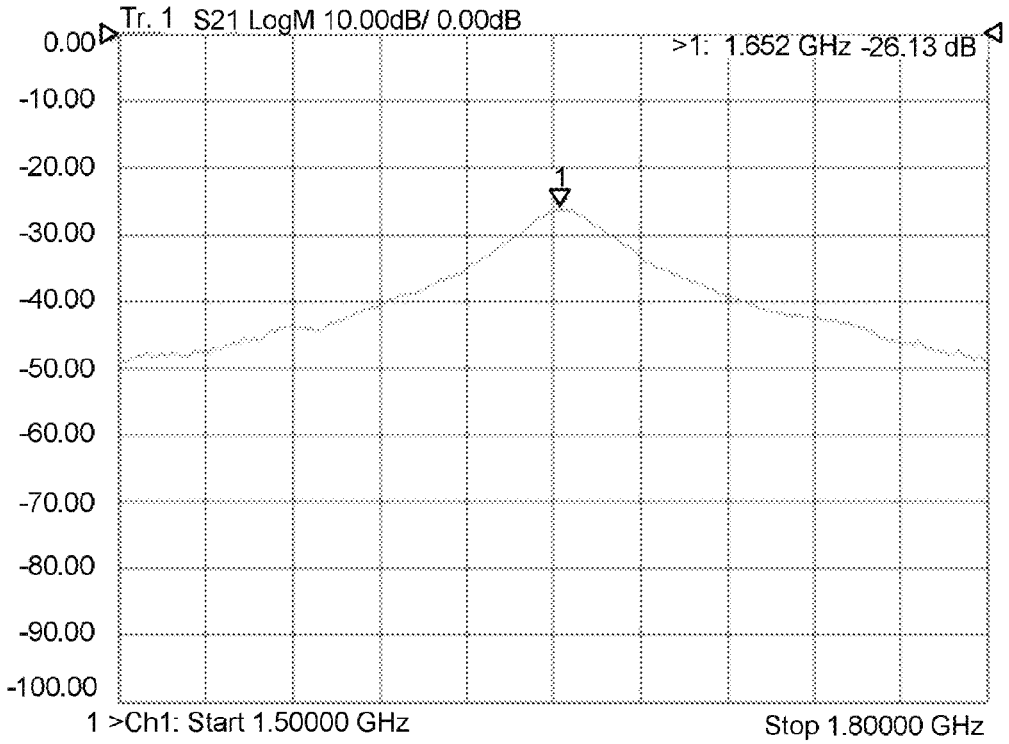
Figure 15:
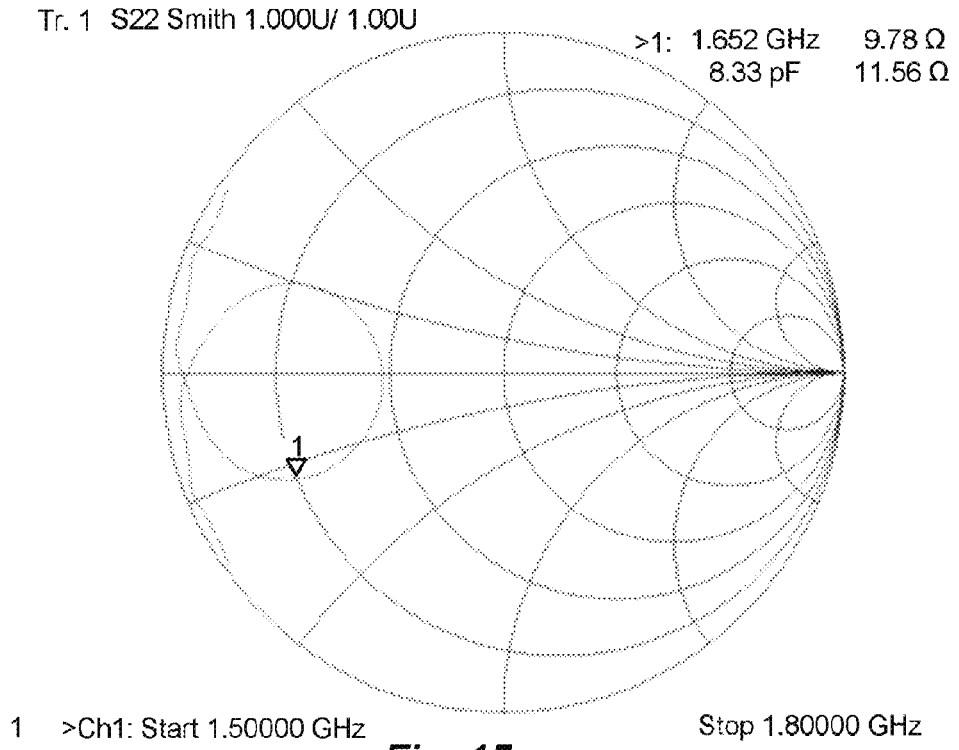
FIGS. 15 and 16 are graphs of impedance and gain measurements taken while the antenna was dielectrically loaded by a phenolic plate.
Figure 16:
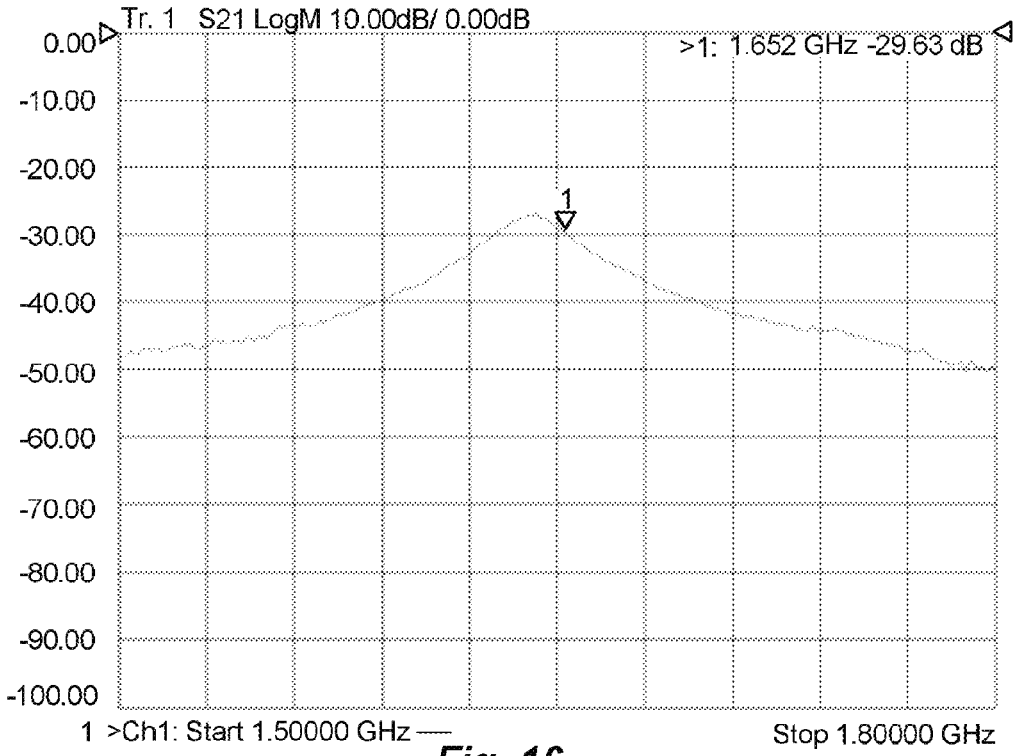
Figure 17:
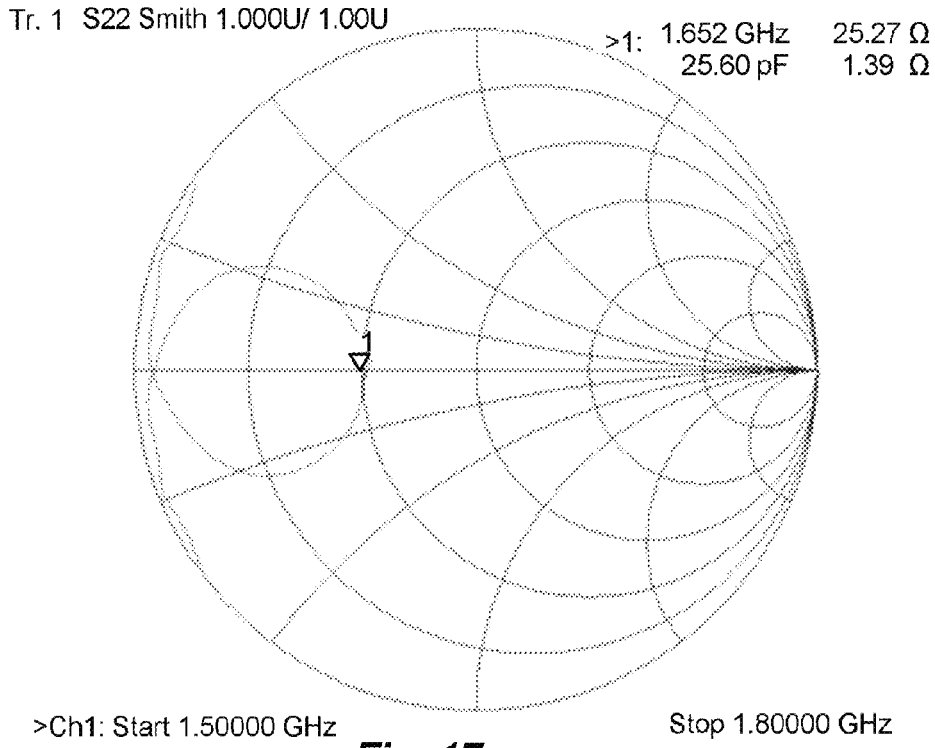
FIGS. 17 and 18 are graphs of impedance and gain measurements taken after the antenna was re-tuned.
Figure 18:
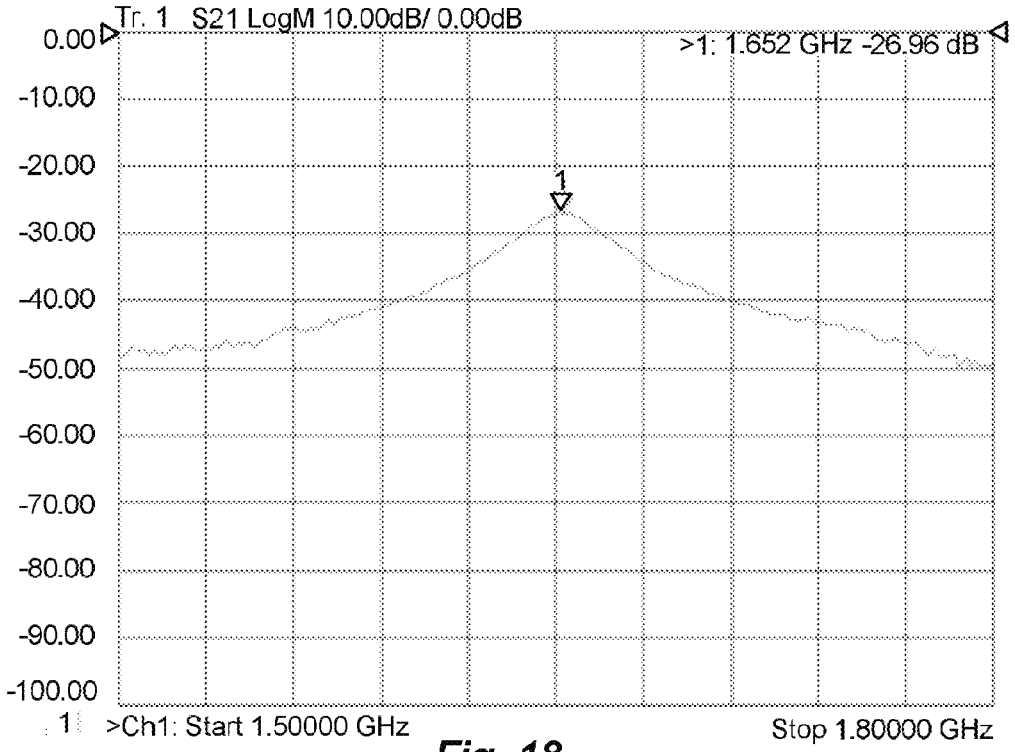

FIGS. 13 and 14 are graphs that illustrate reference impedance and gain measurements of an unloaded loop antenna at about 1.652 GHz. After the measurements of FIGS. 13 and 14 were taken, the antenna was dielectrically loaded by placing a 1/8-inch thick phenolic plate in direct physical contact with the antenna. As a result, the input impedance of the antenna changed from about 25.17+j0.473 ohms (unloaded) to about 9.78−j11.56 ohms (loaded). FIGS. 15 and 16 are graphs of impedance and gain measurements taken while the antenna was dielectrically loaded by the phenolic plate. Adjusting the variable capacitor restored the impedance to about 25.27−j1.39 ohms (re-tuned). FIGS. 17 and 18 are graphs of impedance and gain measurements taken after the antenna was re-tuned. Comparing the Smith charts of FIGS. 13 and 17, it can be seen that the impedance circle doesn't significantly change size, it merely rotates.

Table 1 summarizes results of dielectric loading tests conducted with other dielectric materials, including Sheetrock drywall, Rexolite plastic and polyvinylidene difluoride (PVDF). Of the materials listed in Table 1, phenolic provided the greatest dielectric loading. However, in all cases, the antenna could be re-tuned to nearly the original reference antenna impendence, with a worst-case antenna gain loss of about 3 dB.

TABLE 1

Summary of Dielectric Loading Test
Test frequency 1.652 GHz

| Material | Comment | Real (dB) | Imaginary (dB) | Ref. Gain | Gain Δ (dB) | Return Loss |
|---|---|---|---|---|---|---|
| Reference | No load | 25.17 | 0.473 | −26.13 | 0.0 | −9.59 |
| 1/4" Sheetrock drywall | Detuned | 13.45 | −11.94 | −27.99 | −1.86 | −4.2 |
| 1/4" Sheetrock drywall | Re-tuned | 26.36 | −0.162 | −26.33 | −0.2 | −10.8 |
| 1/2" Rexolite plastic | Detuned | 16.10 | −11.48 | −27.68 | −1.55 | −5.6 |
| 1/2" Rexolite plastic | Re-tuned | 26.61 | −0.182 | −26.64 | −0.55 | −10.29 |
| 1/4" PVDF | Detuned | 15.68 | −11.43 | −28.51 | −1.38 | −5.32 |
| 1/4" PVDF | Re-tuned | 25.58 | −0.427 | −27.18 | −1.05 | −9.96 |
| 1/8" phenolic | Detuned | 9.78 | −11.56 | −29.18 | −3.05 | −3.26 |
| 1/8" phenolic | Re-tuned | 25.27 | −1.39 | −26.96 | −0.83 | −9.6 |

GLOSSARY

As used herein, the following terms have the following definitions.

A microstrip transmission line is a radio frequency (RF) transmission line constructed with a conductor suspended over a ground plane. The conductor and ground plane are separated by a dielectric material. A microstrip transmission line may have free space (air) as a dielectric above the conductor, i.e., on a side of the conductor opposite the dielectric material.

dB (isotropic) is a measure of forward gain of an antenna, compared with a hypothetical isotropic antenna, which uniformly distributes energy in all directions. Linear polarization of the electromagnetic (EM) field is assumed unless otherwise noted. dBiL is this measure for linear polarization, and dBiC is this measure for circular polarization.

Axial ratio is a ratio of orthogonal components of an E-field (electric field). A circularly polarized field is made up of two orthogonal E-field components of equal amplitude and 90 degrees out of phase. Thus, the axial ratio for a perfectly circularly polarized field is 1 (0 dB), whereas the axial ratio for an ellipse is larger than 1 (larger than 0 dB).

While specific parameter values may be recited for disclosed embodiments, within the scope of the invention, the values of all parameters may vary over wide ranges to suit different applications. Although aspects of embodiments may be described with reference to flowcharts and/or block diagrams, functions, operations, decisions, etc. of all or a portion of each block, or a combination of blocks, may be combined, separated into separate operations or performed in other orders. While the invention is described through the above-described exemplary embodiments, modifications to, and variations of, the illustrated embodiments may be made without departing from the inventive concepts disclosed herein. Furthermore, disclosed aspects, or portions thereof, may be combined in ways not listed above and/or not explicitly claimed. Accordingly, the invention should not be viewed as being limited to the disclosed embodiments.

What is claimed is:

1. A loop antenna having a design frequency and a design wavelength of the design frequency, the loop antenna comprising:

a planar electrically conductive ground plane;

an electrically conductive partitioned loop driven element having two ends defining a feed point therebetween, the driven element having a circumference equal to about a first odd multiple of the design wavelength, disposed on a first plane parallel to, and spaced by at most about 0.01 times the design wavelength from, the ground plane, wherein width of the driven element, as measured in the first plane, varies along the circumference, such that two diametrically opposed low-impedance portions of the driven element are each wider than, and have impedances at the design frequency no greater than about one-quarter impedance of, each of two remaining high-impedance portions of the driven element; and a first dielectric material disposed between the ground plane and the driven element.

2. A loop antenna as defined in claim 1, further comprising a first variable capacitor electrically connected across, and disposed within about 1/16 of the design wavelength of, the feed point.

3. A loop antenna as defined in claim 1, wherein the widths of the low-impedance portions depend on spacing between the driven element and the ground plane wherein, for a given design frequency, closer driven element-to-ground plane spacing corresponds with wider low-impedance portions.

4. A loop antenna as defined in claim 1, wherein the impedances of the low-impedance portions depend on spacing between the driven element and the ground plane wherein, for a given design frequency, closer driven element-to-ground plane spacing corresponds with lower impedances of the low-impedance portions.

5. A loop antenna as defined in claim 1, wherein a ratio of the impedances of the high-impedance portions to the impedances of the low-impedance portions depends on spacing between the driven element and the ground plane wherein, for a given design frequency, closer driven element-to-ground plane spacing corresponds with a higher ratio.

6. A loop antenna as defined in claim 1, wherein the width of the driven element varies continuously along the circumference.

7. A loop antenna as defined in claim 1, wherein:

the driven element comprises an approximately rectangular cross-sectional, electrically conductive, first trace attached to one surface of the first dielectric material; and the ground plane comprises an electrically conductive second trace attached to an opposite surface of the first dielectric material.

8. A loop antenna as defined in claim 7, wherein the driven element comprises:

a first elongated portion of the first trace having a length equal to about one-quarter the first odd multiple of the design wavelength and forming a first microstrip, relative to the ground plane and the first dielectric material, one of the high-impedance portions comprising the first microstrip;

a second elongated portion of the first trace having a length equal to about one-quarter of the first odd multiple of the design wavelength and forming a second microstrip, relative to the ground plane and the first dielectric material, perpendicular to the first microstrip, one end of the second microstrip being electrically connected to one end of the first microstrip, one of the low-impedance portions comprising the second microstrip;

a third elongated portion of the first trace having a length equal to about one-quarter of the first odd multiple of the design wavelength and forming a third microstrip, relative to the ground plane and the first dielectric material, perpendicular to the second microstrip, one end of the third microstrip being electrically connected to the other end of the second microstrip, the other of the high-impedance portions comprising the third microstrip; and a fourth elongated portion of the first trace having a length equal to about one-quarter of the first odd multiple of the design wavelength and forming a fourth microstrip, relative to the ground plane and the first dielectric material, perpendicular to the third microstrip, one end of the fourth microstrip being electrically connected to the other end of the third microstrip and the other end of the fourth microstrip being electrically connected to the other end of the first microstrip, the fourth microstrip being electrically partitioned about half way along its length into two portions and defining the feed point therebetween, the other of the low-impedance portions comprising the fourth microstrip.

9. A loop antenna as defined in claim 8, wherein:

the driven element is spaced apart from the ground plane by a distance no greater than about 0.005 times the design wavelength; and the loop antenna exhibits a gain of at least about 1.2 dBiL.

10. A loop antenna as defined in claim 8, wherein:

widths of the first and fourth elongated portions of the first trace are such that the impedance of each of the first and third microstrips is about 10Ω at the design frequency; and widths of the second and third elongated portions of the first trace are such that the impedance of each of the second and fourth microstrips is about 50Ω at the design frequency.

11. A loop antenna as defined in claim 8, wherein:

width of the first elongated portion of the first trace is equal to about width of the third elongated portion of the first trace;

width of the second elongated portion of the first trace is equal to about width of the fourth elongated portion of the first trace; and the width of the second elongated portion of the first trace is at least about three times the width of the first elongated portion of the first trace.

12. A loop antenna as defined in claim 8, further comprising a first variable capacitor electrically connected across, and disposed within about 1/16 of the design wavelength of, the feed point.

13. A loop antenna as defined in claim 8, wherein each of the first, second, third and fourth elongated portions of the first trace is linear.

14. A loop antenna as defined in claim 1, further comprising:

an electrically conductive loop parasitic element having a circumference equal to about a second odd multiple of the design wavelength, disposed on a second plane parallel to, and spaced by at most about 0.01 times the design wavelength from, the driven element, wherein width of the parasitic element, as measured in the second plane, varies along the circumference, such that two diametrically opposed low-impedance portions of the parasitic element are each wider than, and have impedances at the design frequency no greater than about one-quarter impedance of, each of two remaining high-impedance portions of the parasitic element; and a second dielectric material disposed between the driven element and the parasitic element.

15. A loop antenna as defined in claim 14, wherein the width of the parasitic element varies continuously along the circumference of the parasitic element.

16. A loop antenna as defined in claim 14, wherein:

the parasitic element is partitioned and has two ends defining a tuning point therebetween; the loop antenna further comprising:

a second variable capacitor electrically connected across, and disposed within about 1/16 of the design wavelength of, the tuning point.

17. A loop antenna as defined in claim 14, wherein:

the two low-impedance portions of the parasitic element are sized and shaped substantially as the two low-impedance portions of the driven element are sized and shaped;

the two high-impedance portions of the parasitic element are sized and shaped substantially as the two high-impedance portions of the driven element are sized and shaped;

the parasitic element is centered over the driven element, as viewed perpendicular to the first plane; and the parasitic element is rotated about 90 degrees, relative to the driven element, about an axis perpendicular to the first plane and extending through the center of the parasitic element.

18. A loop antenna as defined in claim 17, wherein:

the driven element is attached to one surface of the second dielectric material; and the parasitic element comprises an approximately rectangular cross-sectional, electrically conductive, second trace attached to the other surface of the second dielectric material.

19. A loop antenna as defined in claim 1, further comprising a metallic object disposed on a same side of the ground plane as the driven element, within about 1/16 of the design wavelength of the first plane and within an outer perimeter of the driven element.

20. A loop antenna as defined in claim 19, wherein the metallic object comprises an electronic circuit electrically coupled to the feed point.

* * * * *